United States Patent [19]

Nye

[11] Patent Number: 4,573,485

[45] Date of Patent: Mar. 4, 1986

[54] COIN RUNWAY WITH COIN SEQUENCING FACILITY

[75] Inventor: Charles L. Nye, St. Helens, England

[73] Assignee: The Plessey Company plc, Ilford, England

[21] Appl. No.: 466,026

[22] Filed: Feb. 14, 1983

[30] Foreign Application Priority Data

Feb. 15, 1982 [GB] United Kingdom ..... 8204381

[51] Int. Cl.[4] ..... G07D 3/00

[52] U.S. Cl. ..... 133/3 D; 194/346

[58] Field of Search ..... 194/1 K, 100 A; 133/3 D

[56] References Cited

U.S. PATENT DOCUMENTS 1,433,942 10/1922 Doldt ..... 133/3 D
3,934,692 1/1976 Novak et al. ..... 221/298 X
4,286,703 9/1981 Schuller et al. ..... 194/100 A

FOREIGN PATENT DOCUMENTS 464439 4/1937 United Kingdom ..... 133/3 D

*Primary Examiner*—F. J. Bartuska
*Attorney, Agent, or Firm*—Fleit, Jacobson, Cohn & Price

[57] ABSTRACT

Two embodiments of this invention are disclosed and each concerns a coin storage section of a coin runway which includes two separate coin runways which are diagonally orientated at an angle with respect to each other about the center of the longitudinal axis of each diagonal coin runway. The storage section of the coin runway is arranged to receive coins accepted in a sequence from a coin sorting or separation arrangement and to maintain them in that sequence while they are temporarily stored. In the first embodiment the coin separation arrangement includes a mechanical, moveable gate mechanism for orientating and guiding the coins of varying denominations into the diagonal coin runways of the coin store, whereas in the second embodiment the coin separation arrangement includes a purely fixed mechanical arrangement to achieve the desired coin orientating and guiding action for the coins to be guided to the diagonal coin runways of the coin storage section.

7 Claims, 11 Drawing Figures

COIN RUNWAY WITH COIN SEQUENCING FACILITY

The present invention relates to coin runways. Coin runways of the type disclosed herein find utility in payphone apparatus of the type in which a call is time-charged and in the event of call-time being less than call-time credited, a refund is given. Such payphones are usually microprocessor controlled.

According to the present invention there is provided a coin runway arrangement for accepting a sequence of coins of varying denominations, the runway incorporating a storage section which is so arranged that validated coins entering the storage section are orientated to lie at an angle with respect to each other in order to maintain the sequence of coin acceptance in said storage section and in order to prevent coin overtaking, in which the arrangement of the storage section comprises two separate coin runways which extend longitudinally in the same direction and which are diagonally orientated at an angle with respect to each other in the form of a cross.

The invention will be better understood from the following description of two exemplary embodiments which should be read in conjunction with the accompanying drawings in which.

Two embodiments of this invention are disclosed each concerns a coin storage section of a coin runway which comprises two separate coin runways which are diagonally orientated at an angle with respect to each other about the centre of the longitudinal axis of each diagonal coin runway. The storage section of the coin runway is arranged to receive coins accepted in a sequence from a coin sorting or separation arrangement and to maintain them in that sequence while they are temporarily stored.

In the first embodiment the coin separation arrangement comprises a combination/mechanical moveable gate mechanism 4 for orientating and guiding the coins of varying denominations into the diagonal coin runways of the coin store, whereas in the second embodiment the coin separation arrangements comprises a purely fixed mechanical arrangement to achieve the desired coin orientating and guiding action for the coins to be guided to the diagonal coin runways of the coin store.

Figure 1:
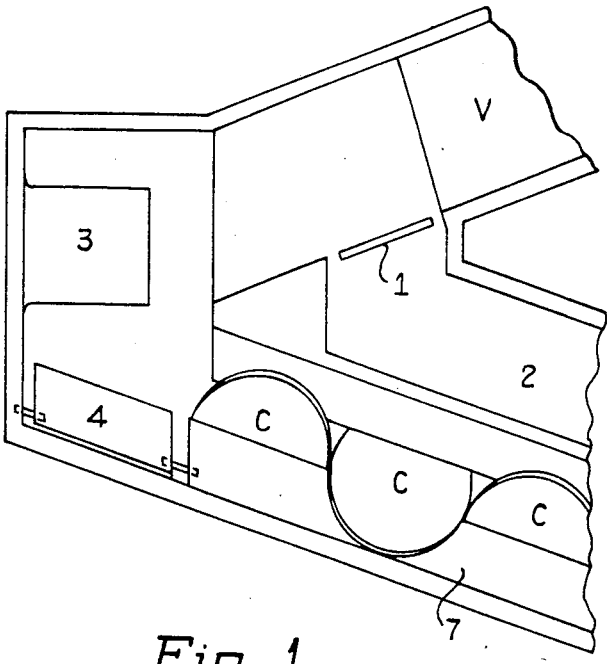
FIG. 1 shows a side-view of the coin runway of the first embodiment in accordance with this invention.
Figure 2:
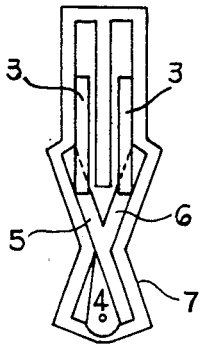
FIG. 2 shows an end-view of the runway of FIG. 1 as viewed at the coin direction changing area with the end-face removed.

Referring now to the drawings of the first embodiment (FIG. 1 and FIG. 2) which is arranged to particularly handle six coins from the U.K. eight coin set, the coins concerned being the 1, 50 pence, 20 pence, 10 pence, 5 pence, and 2 pence coins. When non-validated coins leave a validator means V, an accept/reject gate 1 remains unoperated, and each non-validated coin enters the reject coin runway 2 and is returned to the user. However, when validated coins leave the validator V, the accept/reject gate 1 is operated, and each validated coin passes through a coin guide 3 which guides the coins to maintain them in a substantially fixed plane prior to their entrance into the coin sorting or separation arrangement.

The coin separation arrangement is a gate 4 which comprises a wedge-like flap which is pivoted at each of its ends and which is controlled to operate in response to signals supplied from a central processing unit (not shown, but which forms part of the payphone) which responds to validating signals from the validator V. The gate 4 operates in such a manner that coins C are alternately orientated and guided into the diagonal coin runways 5 and 6 of the cross-like coin store 7. Accordingly no two coins are adjacent to each other in the same leg of the coin store. This avoids coin overtaking and coin jamming.

Referring now to the drawings of the second embodiment, (FIG. 3 to FIG. 11) this invention enables a multi-coin set to be stored in a coin-store in such a way that power need only be supplied to one exit gate in order to achieve complete coin management. The proposal is for a device that will accept validated coins of varying denominations, separate them according to their physical dimensions and store them in such a way that they are retained in the store, in the sequence in which they entered, and such that coins of less than half the thickness of others in the set can be accommodated within the coin runway, without the possibility of coins overtaking one another, or jamming.

Figure 3:
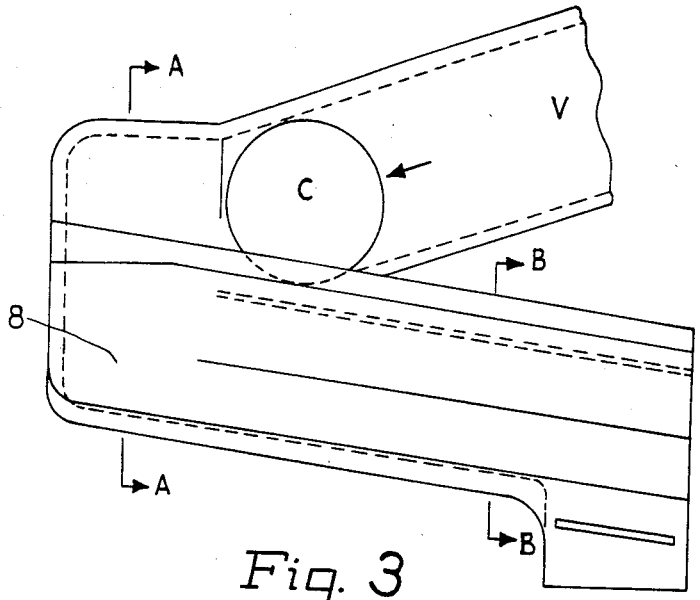
FIG. 3 shows a side-view of the coin runway of the second embodiment in accordance with this invention.
Figure 4:
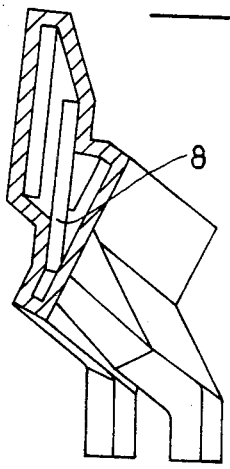
FIG. 4 shows a part sectional and perspective view of the runway as shown in FIG. 3 with the sectional portion being viewed in the direction of arrows A—A.
Figure 5:
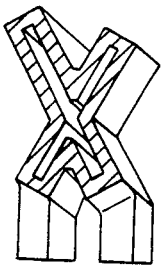
FIG. 5 shows a further part sectional and perspective view of the runway as shown in FIG. 3 with the sectional portion being viewed in the direction of arrows B—B.
Figure 6:
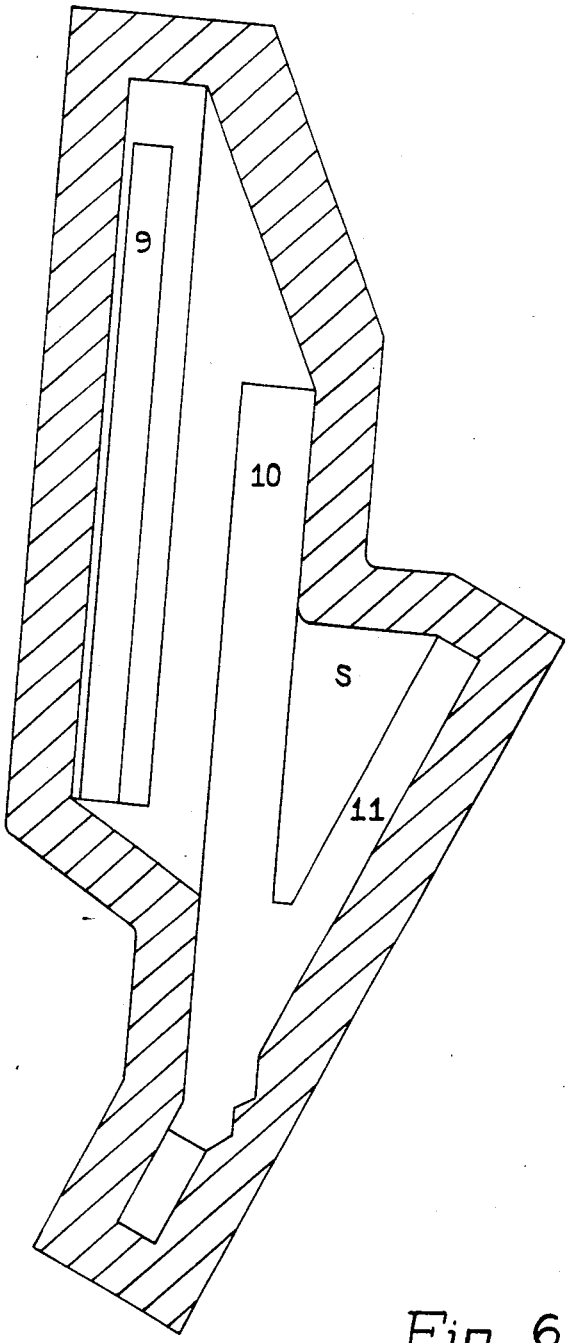
FIG. 6 to FIG. 11 illustrate sectional views as viewed in the direction of arrows A—A demonstrating the arrangements, for various coin configurations, within the runway.
Figure 10:
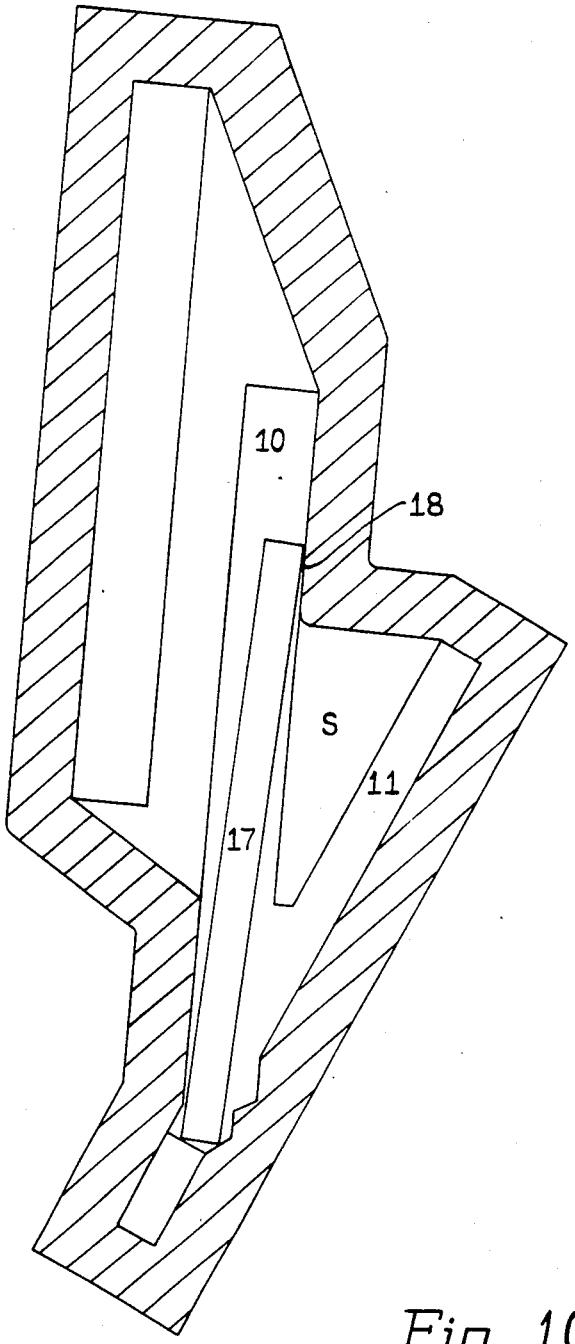
Figure 11:
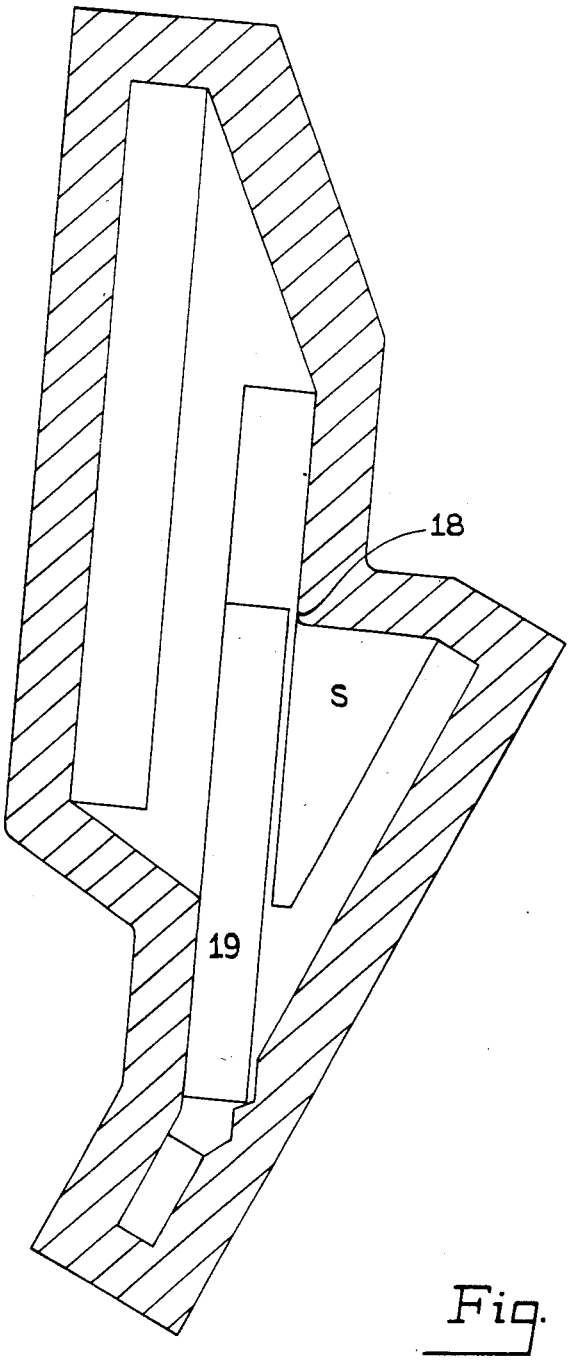

Consider a coin C, 9, leaving the validator V (FIG. 3). When it reaches the end of the upper runway it is moved sideways and downwards by the geometry of the runway and enters the separation area S (FIG. 5, FIG. 10, FIG. 11). In this area thick coins rest on the upper section of the stepped side of the runway (FIG. 10, FIG. 11) and are guided into the wider diagonal coin runway 10 of the coin store.

Figure 8:
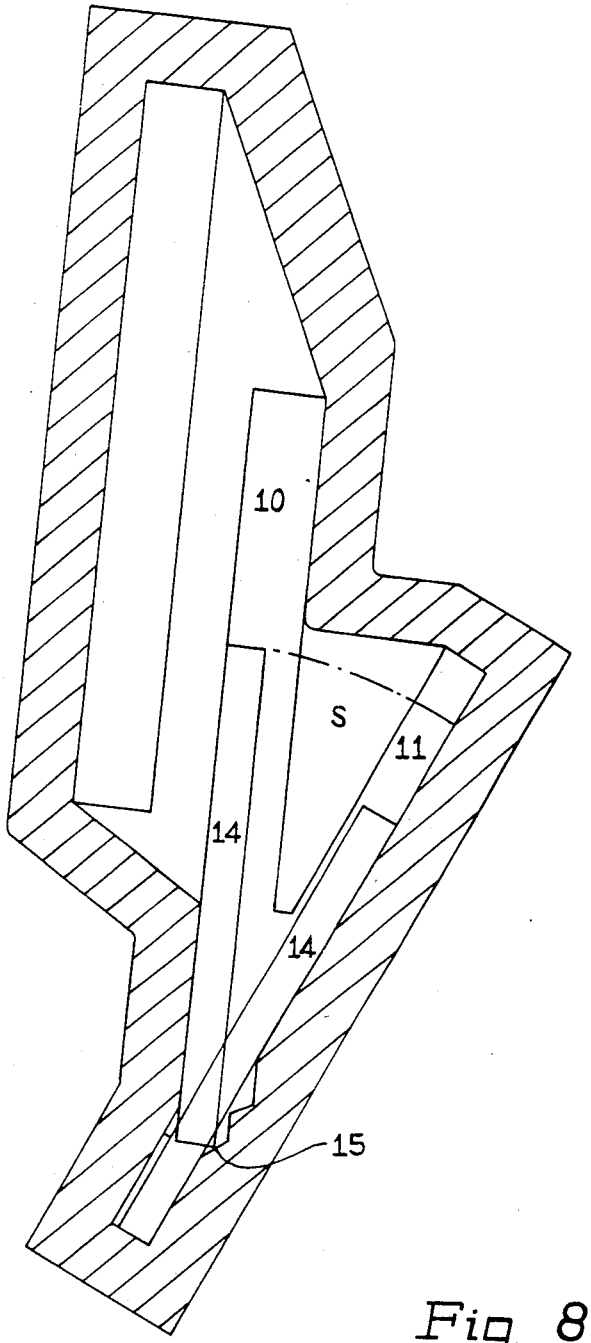
Figure 9:
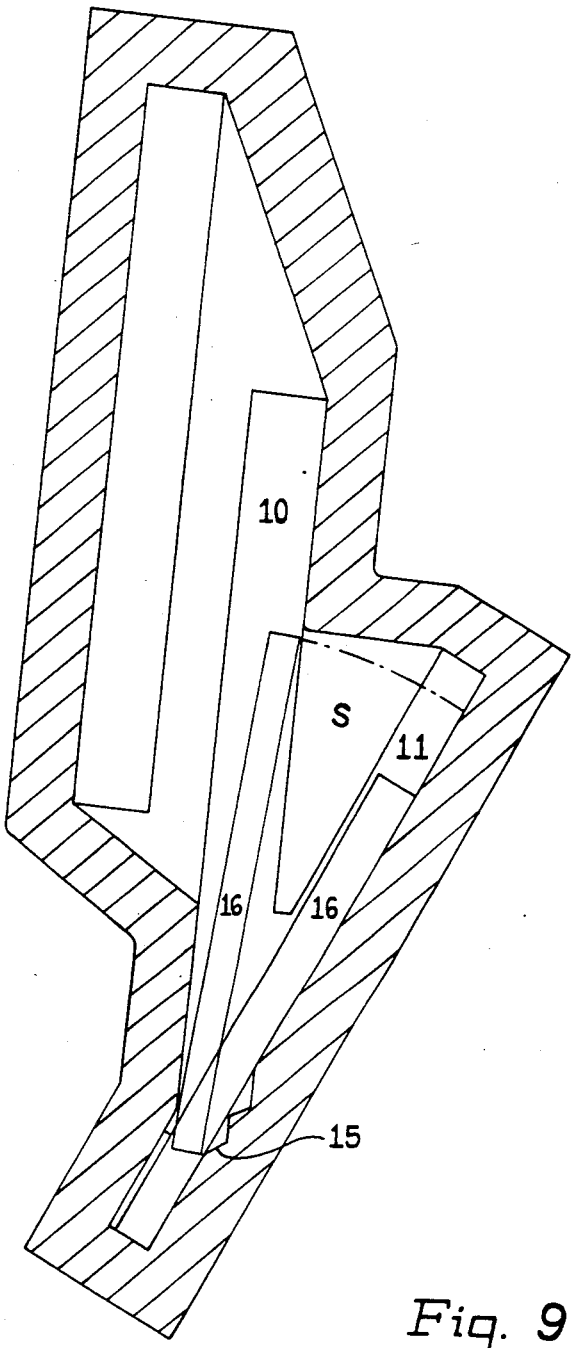

Thin coins however drop into the lower section of the separation area S and are guided into the narrower diagonal coin runway 11 of the coin store (FIG. 8, FIG. 9). In this way a thin coin of diameter less than that of a thick coin, from which it requires to be separated, is caused to fall below that part of the separation area S that provides an overlap 12, 18, to guide thick coins into the wider diagonal coin runway 3 of the coin store, so it decreases the virtual diameter of a thin coin.

This embodiment is also designed to handle six coins from the U.K. eight coin set, the wider diagonal coin runway 10 handling the 1, 50 pence and 10 pence coins while the narrower diagonal coin runway 11 handles the 20 pence, 5 pence and 2 pence coins.

Figure 7:
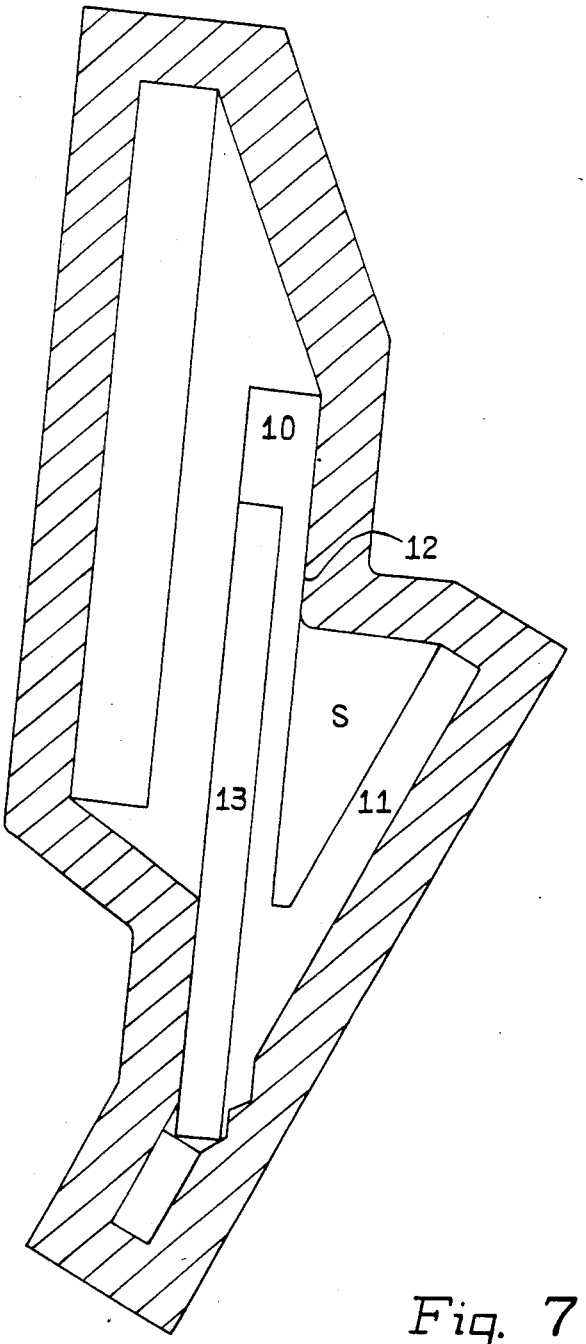

FIG. 7 shows a 50 pence coin 13 in the separation area S for guiding into the wider diagonal coin runway 10. It should be noted that an overlap 12 is provided to ensure that the coin is guided into the wider diagonal coin runway 10.

FIG. 8 shows a 20 pence or 5 pence coin 14 being guided into the narrower diagonal coin runway 11. In this figure it should be noted how the inside wall of the separation area S is contoured to a particular angle 15 to ensure that the coin tilts into the narrower diagonal coin runway 11.

FIG. 9 shows how a 2 pence coin 16 is guided. Again it should be noted how the inside wall of the separation area S is contoured to a particular angle 15.

FIG. 10 and FIG. 11 show the handling of the 10 pence 17 and 1 coins 19 respectively. It is important to note again the overlap 18 employed for guidance purposes.

From the separation area the two parts of the store are diagonally orientated relative to each other, as shown in section B—B, so that coins in both parts 10 and 11 of the store remain in sequence. A gate (not shown) at the lower end of each part of the store is common to both exits and operates to simultaneously open both exits to enable coins to leave the store.

There can only be a coin at the lower position adjacent to the exit gate of one part of the store, so that a coin in this position automatically excludes a coin from the lower position of the other part of the store.

It should be understood that in the first described embodiment the coin separation gate can also be arranged to operate in modes other than that described e.g. coins of given size or value parameters can be directed into either of the diagonal coin runways 5 and 6 of the coin store 7 as desired by pre-programmed operation of the separation gate 4 in accordance with these parameters.

I claim:

1. A coin runway arrangement for accepting a sequence of coins of varying dimensions, said coin runway arrangement comprising:

coin validating means for allowing passage of select validated coins;

a coin storage section for receiving validated coins from the coin validating means, the coin storage section comprising two separate coin runways extending longitudinally in the same direction at an inclined angle to the horizontal and diagonally oriented at an angle with respect to each other about the centre of the longitudinal axis of each diagonal runway in the form of a cross; and coin separating means located preceding the coin storage section in the path of the coins for separating validated coins into two distinct groups in accordance with their dimensions, each group including coins of different dimensions from the other group, and each group including coins of different dimensions from each other.

2. A coin runway arrangement as claimed in claim 1, wherein the coin separating means located in the path of said coins includes a stepped runway side having an upper section and a lower section where coins of one group of dimensions rest on the upper section of the stepped side and are guided and oriented to enter one of the diagonal coin runways and where coins of the other group of dimensions drop into the lower section of the stepped side and are guided and oriented to enter the other of the diagonal coin runways.

3. A coin runway arrangement as claimed in claim 2, wherein the dimensions of said one diagonal coin runway are greater in width and greater in height than the corresponding dimensions of said other of the diagonal coin runways.

4. A coin runway arrangement as claimed in claim 3, wherein 1, 50 pence, and 10 pence coins of the U.K. are guided into said one diagonal coin runway and wherein 20 pence, 5 pence and 2 pence coins of the U.K. are guided into said other diagonal coin runway.

5. A coin runway arrangement for accepting a sequence of coins of different dimensions, said coin runway arrangement comprising:

coin validating means for allowing passage of select validated coins;

a coin storage section for receiving validated coins from the coin validating means, the coin storage section comprising two separate coin runways extending longitudinally in the same direction at an inclined angle to the horizontal and diagonally oriented with respect to each other about the center of the longitudinal axis of each diagonal runway in the form of a cross; and coin separating means located preceding the coin storage section in the path of the coins for separating validated coins into two distinct groups in accordance with their dimensions, each group including a plurality of mixed coins of different dimensions from the other group.

6. A coin runway arrangement as claimed in claim 5, wherein the coin separating means located in the path of said coins includes a stepped runway side having an upper section and a lower section where coins of one group of dimensions rest on the upper section of the stepped side and are guided and oriented to enter one of the diagonal coin runways and where coins of the other group of dimensions drop into the lower section of the stepped side and are guided and oriented to enter the other of the diagonal coin runways.

7. A coin runway arrangement as claimed in claim 6, wherein the dimensions of said one diagonal coin runway are different in at least one of width and height than the corresponding dimensions of said other of the diagonal runways.

* * * * *